United States Patent [19]

Gebhard

[11] 4,323,233

[45] Apr. 6, 1982

[54] PENDULUM SWING

[75] Inventor: Albert W. Gebhard, Boulder, Colo.

[73] Assignee: Gerico, Inc., Denver, Colo.

[21] Appl. No.: 176,062

[22] Filed: Aug. 6, 1980

Related U.S. Application Data

[63] Continuation of Ser. No. 884,472, Mar. 8, 1978, abandoned.

[51] Int. Cl.[3] ..... A63G 9/16

[52] U.S. Cl. ..... 272/86; 185/5

[58] Field of Search ..... 272/86, 132; 5/109; 185/4, 5, 6, 27, 28, 29, 31, 37, 38, 39, 40; 416/59; 297/273-280

[56] References Cited

U.S. PATENT DOCUMENTS

| | | | |
|---|---|---|---|
| 76,601 | 4/1968 | Carroll | 272/76 |
| 389,834 | 9/1888 | Caldwell | 272/86 |
| 461,541 | 10/1891 | Bunker | 272/86 |
| 518,967 | 5/1894 | Poole | 272/132 |
| 545,451 | 9/1895 | Bunner | 272/86 |
| 898,948 | 9/1908 | Wilderman | 272/86 |
| 1,300,680 | 4/1919 | Wilson | 272/86 |
| 1,650,417 | 11/1927 | Benninger | 272/132 |
| 2,274,310 | 2/1942 | Walter | 272/76 |
| 3,526,400 | 9/1970 | Carpenter et al. | 272/76 |
| 3,995,853 | 12/1976 | Deluty | 272/132 |
| 4,077,626 | 3/1978 | Newman | 272/132 |

*Primary Examiner*—Richard C. Pinkham
*Assistant Examiner*—T. Brown
*Attorney, Agent, or Firm*—John E. Reilly

[57] ABSTRACT

An infant swing includes a uni-axial weight-biased pendulum escapement motor actuator with a weighted body that glides up and down one of the support legs of the swing and a rewind apparatus having a coiled torsion spring which rewinds the weight cord around a reel when the weight is repositioned to a position of potential energy useable for actuating the swing, and an axially biased unidirectional slip clutch. The swing also includes two rear legs which extend downwardly from a frame to support the swing in combination with two similarly downwardly extending front legs, the rear legs being foldable into parallel relation to the front legs for transportation and storage.

18 Claims, 9 Drawing Figures

PENDULUM SWING

This application is a continuation application of Ser. No. 884,472, filed Mar. 8, 1978, (abandoned), for WEIGHT ACTUATED SWING, invented by Albert W. Gebhard.

BACKGROUND OF THE INVENTION

The present invention generally relates to swings and more particularly to swings having weight-biased escapement-type drive motors for actuating the swing.

Swings are a common source of recreation, enjoyment and relaxation for children and adults, and actuator mechanisms to maintain the motion of swings with little or no effort required of the occupants are well known. It is also quite common to use such mechanically actuated swings to amuse and relax infants for a period of time allowing the parent to go about other activities while the child is swinging. Most of these mechanically actuated infant swings utilize a highly resilient main spring which must be tightly wound to provide sufficient biasing force to actuate the swing. Such devices are not only prone to mechanical breakdown and are difficult to wind, but they can also be safety hazards to small children in the event the spring should break or become detached. Such mechanisms also generate a loud noise which is undesirable since it would tend to wake a sleeping baby as it is being rewound.

A weight-biased motor is preferable from the standpoint of safety and convenience, and many weight-biased actuator motors for swings have been assembled in the past. For example, the following U.S. patents disclose weight-biased motors for driving swings: No. 389,834, issued to W. Caldwell; No. 461,541, issued to I. Bunker; No. 545,451, issued to J. Brunner; No. 1,300,680, issued to J. Wilson; and No. 2,272,310, issued to E. Walter. However, none of these prior art patents discloses an actuator mechanism which is compactly designed for use in infant swings and which are convenient to operate as well as portable for transportation and storage.

SUMMARY OF THE INVENTION

Accordingly, it is an object of the present invention to provide a compact, reliable and efficient weight-biased actuator mechanism for an infant swing.

It is also an object of the invention to provide a weight-biased actuator mechanism for a swing in which is included a rewind mechanism for rewinding the weight suspending cord around a reel as the weight is being relocated to a higher position and a unidirectional clutch for allowing the reel and rewind mechanism to rotate in a reverse direction independent of the other components of the actuator mechanism.

It is another object of the present invention to provide a weight-biased actuator mechanism for imparting and maintaining swinging or pendulum motion to a swing which mechanism includes a single main shaft with the major components mounted on the main shaft or positioned concentric thereto.

It is still another object of the present invention to provide a portable infant swing equipped with a weight-biased actuator that is both convenient to use and safe for children's environment.

A compact, portable swing apparatus of the present invention is particularly adapted for safe use in amusing infants and small children, and includes a weight-biased, escapement governed motive drive source for imparting and maintaining pendulum-like swinging motion to the swing for an extended time. The apparatus includes a frame supported by four legs with a main shaft extending substantially the width of the frame. A swing seat is suspended on hangers from the main shaft, and the components of the motive drive source, which include a reel, ratchet and pawl escapement mechanism, rewind mechanism, and unidirectional clutch mechanism, are all compactly and neatly mounted on or concentric with the main shaft. A weighted body depends from a flexible cord attached to and partially wound around the reel and glides up and down one of the legs of the swing. The two rear legs of the swing are foldable into a position substantially parallel and adjacent to the front legs for carrying and storage convenience.

The escapement means includes a unique ratchet and pawl arrangement wherein a pin-type spring is utilized to bias both pawls into engagement with the teeth on the ratchet wheel and also to withdraw the holding pawl from engagement when the return cycle of the swing forces the motion imparting pawl against the bias of the spring on the return portion of the cycle.

The rewind mechanism of the motor includes a coiled torsion spring mounted concentric with the shaft between the reel and the frame, one end of which spring is anchored to the frame and the other end of which is attached to the reel, such that the weight induced rotation of the ratchet wheel in the operating mode imparts rotating motion to the coiled torsion spring winding it to a position of potential energy which in turn is reimparted to rotate the reel in a reverse direction when the weight is raised, thereby rewinding the cord onto the reel.

In order to maintain the compactness of the design and safety features of the mechanism, the coiled torsion spring is relatively small and has only enough strength to rotate the reel in a reverse direction independently of the main shaft and escapement mechanism. Therefore, a unidirectional clutch is included which effects engagement between the reel and the main shaft in the operation mode when the weight is turning the reel in the forward direction, but which disengages from the shaft when the weight is raised and the rewind spring rotates the reel in the opposite direction. The clutch is in the form of an axially biased unidirectional slip clutch including a sleeve axially fixed and keyed to the main shaft that has a plurality of saw-tooth shaped lugs or projections which engage with corresponding oppositely directed saw-tooth shaped lugs or projections on the hub of the reel. The reel is both axially and rotationally slidable on the main shaft, and a coiled compression spring is mounted around the main shaft internally concentric with the rewind spring between the frame and the reel. One end of the compression spring bears against the frame, and the opposite end bears against the reel to urge the projections on the reel into engagement with the projections on the sleeve when the reel is rotated forwardly in the swing operation mode.

Even though the compression spring is constantly biased against the reel, rotation of the reel in the reverse direction by the torsion spring causes corresponding teeth in the reel and sleeve to glide or slip over each other by allowing axial sliding of the reel on the shaft so that the reel can rotate in a reverse direction independent of the shaft. In order to maintain structural integrity of the motor, a unique spring housing and limit stop means is provided to hold the compression spring in place and limit the axially sliding movement of the reel for a distance sufficient to allow the teeth to glide over one another in the reverse mode, but not enough to impair the structural assembly of the motor components.

The flexible cord is attached to the weighted body with a releasable clip that maintains the attachment under normal conditions, but which releases in the event an abnormal load is applied, such as a child pulling or hanging on the weighted body. The weighted body also has a soft, pliable bottom portion to cushion any impact of the body in the event is should fall to minimize the chance of injury in such circumstances as to a child's foot. A spacer sleeve around the bottom of the leg on which the weighted body glides can also be used to limit the downward fall of the weighted body.

BRIEF DESCRIPTION OF THE DRAWINGS

Other objects, advantages and capabilities of the present invention will become more apparent as the description proceeds taken in conjunction with the accompanying drawings, in which.

DESCRIPTION OF THE PREFERRED EMBODIMENT

Figure 1:
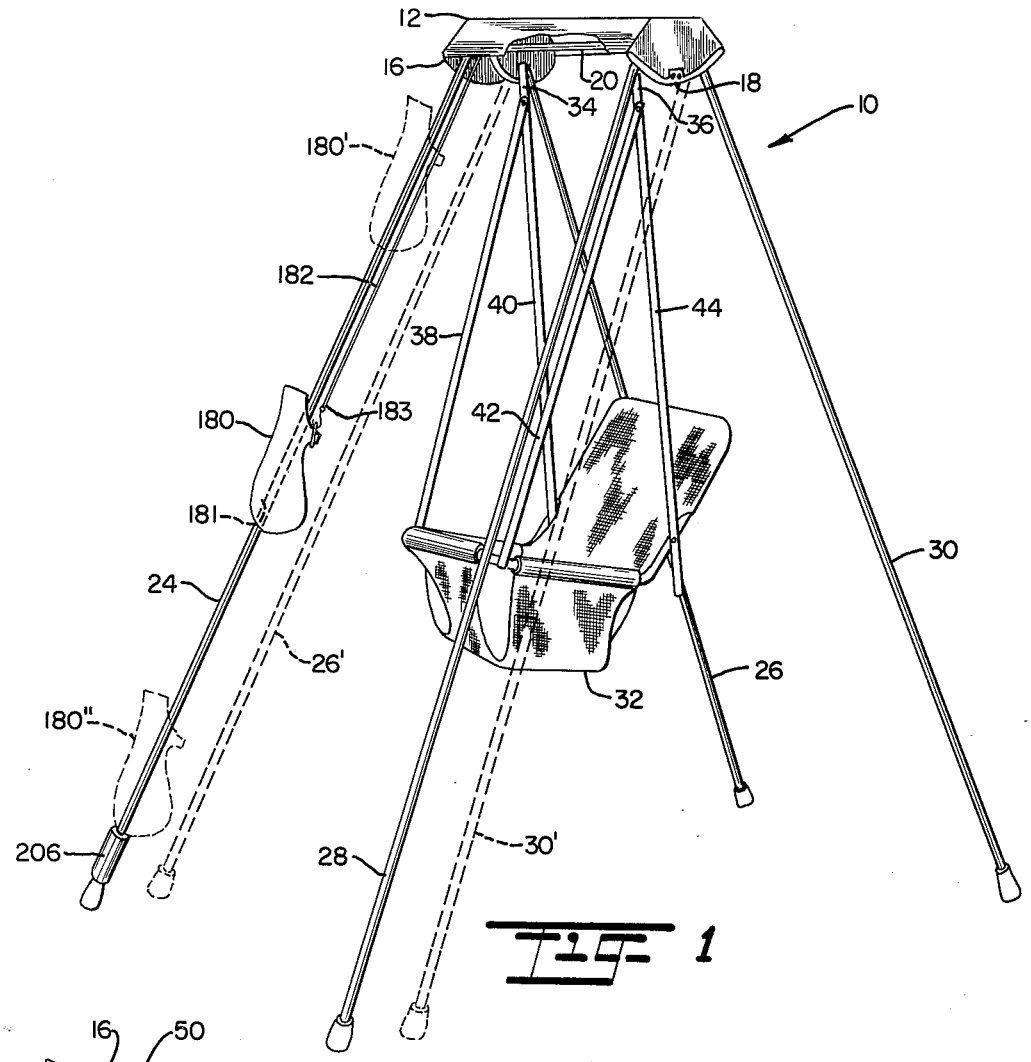
FIG. 1 is a perspective view of the swing, the rear legs in folded position being shown in broken lines, and the maximum up and maximum down positions of the weighted body also being shown in broken lines.

The swing 10 of the present invention is comprised basically of a frame supported by four legs 24, 26, 28, 30, a swing seat 32 suspended under the frame between the legs, and a motor 50 for imparting pendulum or swinging motion to the swing seat 32. The frame has a right end section 16 and a left end section 18 rigidly connected in spaced-apart relation to each other by a pair of parallel, spaced-apart tubular frame members 20, 22. The motor 50 is located within the right frame section 16. A cover or hood 12 is positioned over the frame to conceal the motor and to prevent children's hands from coming into contact with the moving parts of the motor.

Figure 2:
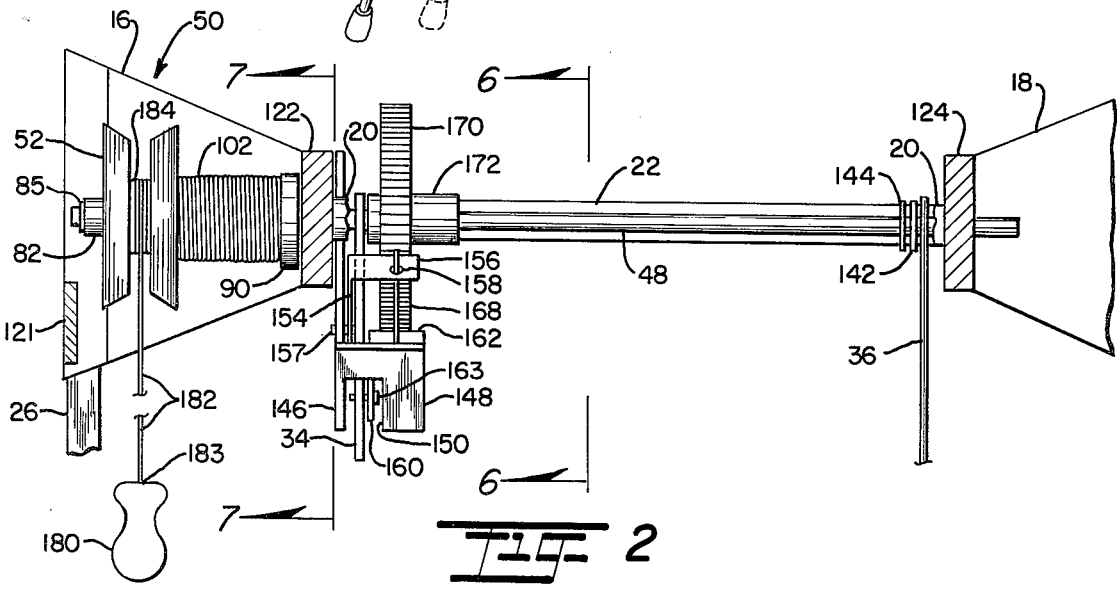
FIG. 2 is an enlarged front elevation view of the motor and shaft assembly with the front and top portions of the frame removed to simplify illustration.
Figures 3, 7:
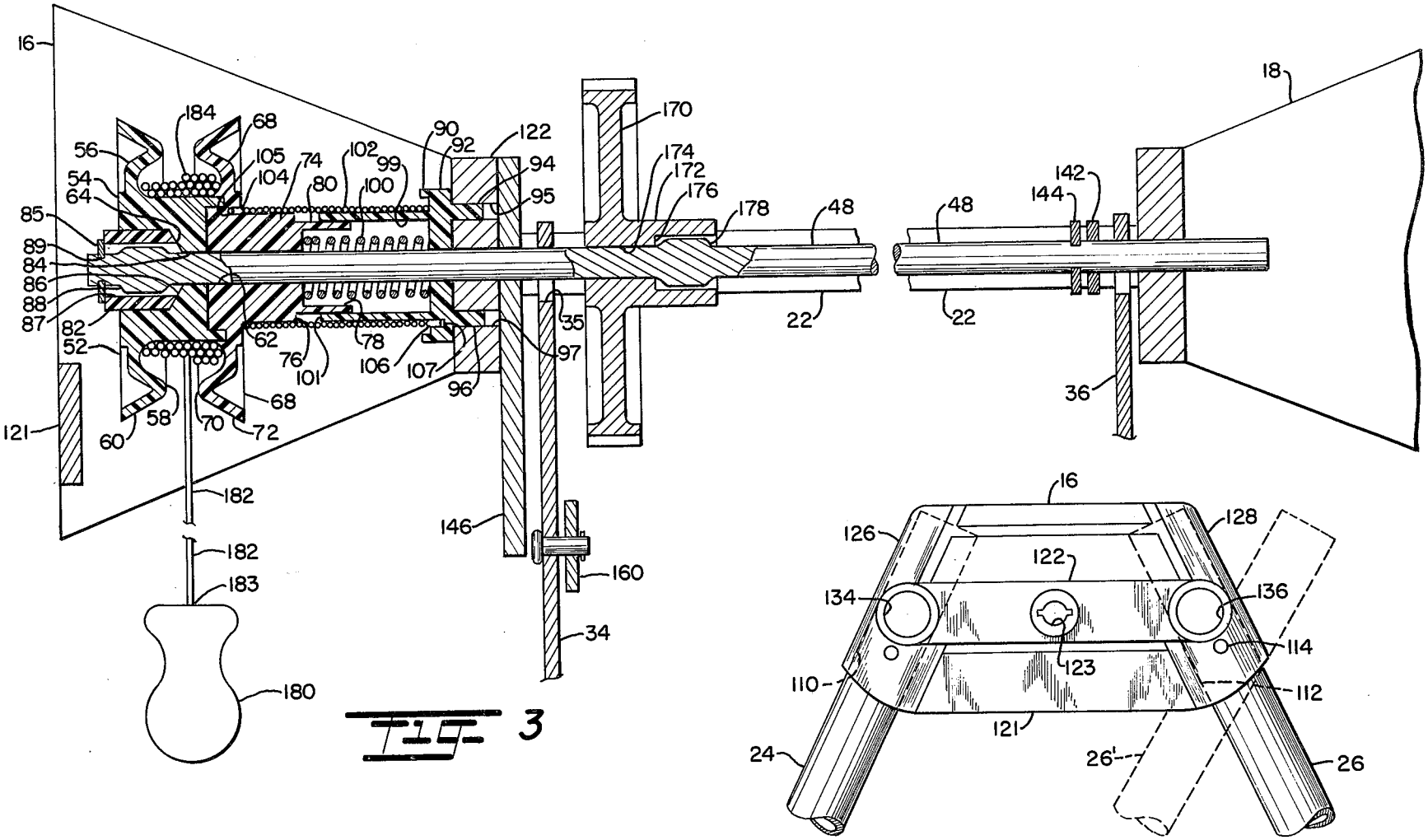
FIG. 3 is a cross-sectional view of the motor and shaft apparatus shown in FIG. 2.
FIG. 7 is a side elevational view of the right frame section taken along lines 7—7 of FIG. 2, the rear leg in folded position being shown in broken lines, and the components of the motor removed for clarity of illustration.
Figure 4:
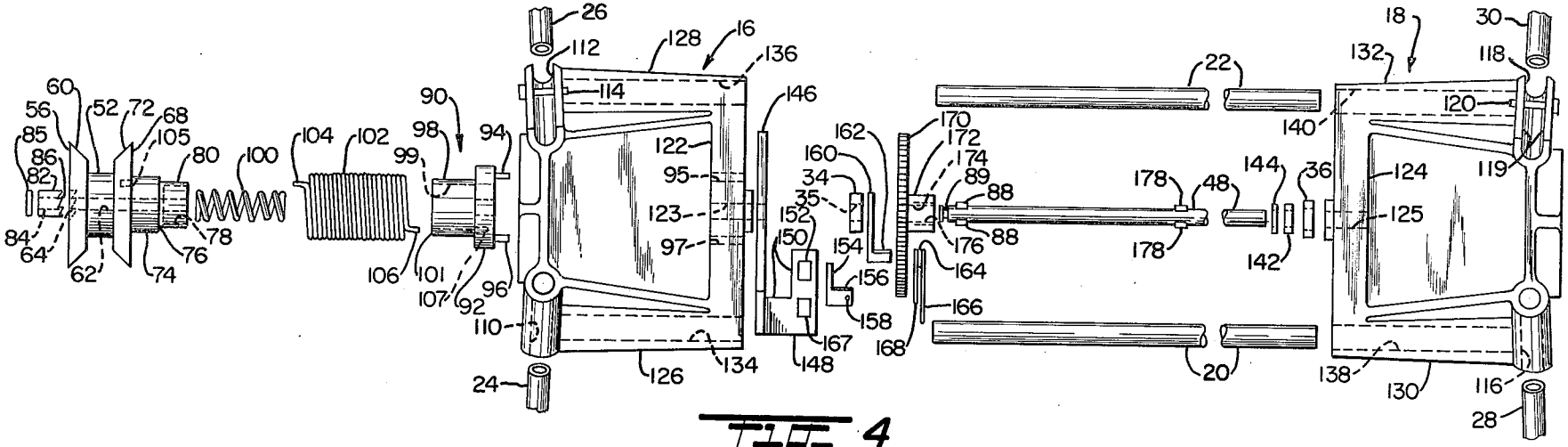
FIG. 4 is an exploded plan view of the components of the frame and motor.

The frame is best illustrated in FIGS. 2, 3 and 4 where it can be seen that the right end section 16 is a specially formed rectangular configuration comprised of a front segment 126, and a rear segment 128 connected together by an outside crossbar 121 and an inside crossbar 122. Front segment 126 includes a bore 134 for receiving and retaining tubular frame member 20, and rear segment 128 includes a bore 136 therein for receiving tubular frame member 22. The left frame section 18 also has a similar bore 138 in front segment 130 for receiving the left end of tubular frame section 20 and a bore 140 in rear segment 132 for receiving the left end of the rear tubular frame member 22.

The right front leg 24 and the right rear leg 26 are attached to the right end segment 16 of the frame in sockets 110, 112, respectively, provided for that purpose. Likewise, left leg 28 and left rear leg 30 are attached to the left frame segment 18 in sockets 116, 118, respectively. As best seen in FIGS. 4 and 7, the sockets 110, 116 for the front legs are enclosed bores which receive the respective front legs 24, 28 to provide a rigid attachment of the legs to the frame. The rear sockets 112, 118, however, are open-sided troughs which receive the rear legs, 26, 30, respectively, and are pivotally attached therein by pins 114, 120, respectively, in a manner which allows pivotal movement of the legs for folding to a position approximately parallel to the front legs for transporting and storage. For example, the rear legs in the alternative folded position are indicated at 26', 30' in FIGS. 1 and 7. The lateral openings between the lips 113, 119 of sockets 112, 118, respectively, are slightly narrower than the diameters of the respective legs 26, 30, so that the legs are securely held therein when in the normal unfolded position, but can be forceably sprung out of the sockets for folding.

A main shaft 48 extends transversely from the right section 16 to the left section 18 between tubular frame members 20, 22. The shaft extends through and is journaled in bore 123 in the inside crossbar 122 of right frame section 16, and the opposite end of shaft 48 extends through and is journaled in bore 125 in inside crossbar 124 of left frame section 18. The swing seat 32 is suspended from hangers 34, 36 which are slidably mounted on the main shaft 48. As illustrated in FIG. 1, the swing seat 32 is supported by right front strap 38 and right rear strap 40 which are attached to the right hanger 34, and by left front strap 42 and left rear strap 44 which are attached to left hanger 46. A keeper 144 is provided on shaft 48 to maintain hanger 36 in position adjacent left frame section 18, and a spacer 142 is provided between keeper 144 and hanger 36 to enhance smooth, non-binding operation.

Referring to FIG. 2, the motor 50 is positioned on the right side of the frame with most of the components being compactly positioned within right frame section 16. A significant feature of this invention involves the configuration and arrangement of the components of the motor 50 in a compact, safe arrangement on or concentric to the common shaft 48 in a manner which is very conductive to a swing 10 of the size and type described. Since the swing 10 is designed primarily for infants or small children, the motor 50 is provided to impart and maintain pendulum-like or oscillating swinging motion of the swing seat 32 to amuse an infant or child while the parent attends to other matters in the vicinity. To accomplish this objective, the motor 50 is a weight-biased, escapement governed motor, which both imparts pendulum motion to the swing and utilizes the pendulum motion of the swing to actuate components of the escapement mechanism. As best seen in FIGS. 2, 3, 4, and 6, the primary components of the motor 50 include a reel 52 having a weighted body 180 suspended therefrom on a flexible cord 182 which is partially wound around and attached to the reel 52, an escapement mechanism comprised of a ratchet wheel 170 and pawls 154, 160, a rewind mechanism comprised essentially of a coiled torsion spring 102, and a unidirectional clutch mechanism for engaging the reel 52 with the main shaft 48 as will be described in more detail below.

As briefly described above, the motor 50 is rotated by the gravitational force of the weighted body 180 acting on the reel 52. The reel is comprised of two portions, a right portion 54 and a left portion 66, primarily for production line manufacturing purposes, which right and left portions 54, 66 are permanently bonded together in the configuration best illustrated in cross section in FIG. 3. The reel 52 includes a hub 74 and a left flange 68 extending radially outwardly from the hub 74. The right portion 54 also includes a similarly configured right flange 56 extending radially outwardly and axially spaced from the left flange 68. The space between the flanges 56, 68 receives and retaoms the flexible cord 182 as it is wound around the reel 52. Each flange, 56, 68, has an annular rib 58, 70, respectively spaced radially outward from the hub and facing each other to form a restricted opening through which the flexible cord 152 is wound onto the reel 52 to enhance a neat and even winding pattern and to avoid snags and tangles of the cord 152 which could interfere with the operation of the motor 50. From the restriction ribs 58, 70, the flanges 56, 68 are sloped outwardly away from each other to form include guide surfaces 60, 72, respectively, which also act to guide the flexible cord 182 smoothly and without interference into the space between the flanges 56, 68. The flexible cord 182 is shown in FIG. 3 with one end 183 attached to the weighted body 180, and the opposite end 184 partially wound around and attached to the reel 52. As the force of gravity pulls the weighted body 180 downwardly, it tends to unwind the flexible cord 182 from the reel 52 causing the reel 52 to rotate in a forward direction, and which through the clutch, as will be described below, also causes the main shaft 48 to also rotate in a forward direction.

The escapement mechanism, as mentioned above, governs the forward rotation of the shaft 48 as well as imparts the rotation of the shaft 48 to the swing 34 in a pendulum-like or swinging motion. Again, referring to FIGS. 2, 3, 4, and 6, the escapement mechanism includes a ratchet wheel 170 with unidirectional inclined teeth 171 around its peripheral surface and a pair of pawls 154, 160. The right swing hanger 34 is slidably mounted on the shaft 48 positioned through hole 35 near the upper end of hanger 34, and positioned inwardly a short distance from the inner crossbar 122 of right frame section 116. The ratchet wheel 170 is also mounted on the shaft 48 inwardly adjacent the hanger 34, the shaft 48 being inserted through bore 174 in the hub 172 of the ratchet wheel 170. The ratchet wheel 170 is keyed to the shaft 48 by flattened keys 178 on shaft 48 positioned in the slotted keyway 176 in the hub 172 of ratchet 170 such that rotation of the main shaft 48 is imparted to the ratchet wheel 170.

A pawl support plate 146 is affixed to the inside surface of the inside bar 122 of right frame section 16 and extends downwardly and slightly forwardly terminating in a spring mounting plate 148 extending inwardly at a right angle to the vertical pawl support plate 146. The spring mounting plate 148 has a notched out clearance slot 150 to allow for the forward portion of the swinging motion of the hanger 34.

A first or holding pawl 154 is pivotally attached to the vertical pawl support 146 and extends upwardly in a tangential relationship to the forward peripheral surface of the ratchet wheel 170 and terminates in an inwardly extending pallet 156 which is engageable with the teeth 171 on the ratchet wheel 170. The first pawl 154 is pivotally attached to the pawl support plate 146 by pin 157 extending through hole 155 in the lower end of pawl 154.

A pin-type spring 164 is mounted with one leg 166 affixed to the spring mounting plate by crimped fasteners 152, 167 and its other leg 168 extending upwardly into engagement with pallet 156 by extending through hole 158 in pallet 156, thereby biasing pallet 156 of holding pawl 154 into engagement with the teeth 171 of ratchet wheel 170.

Figure 6:
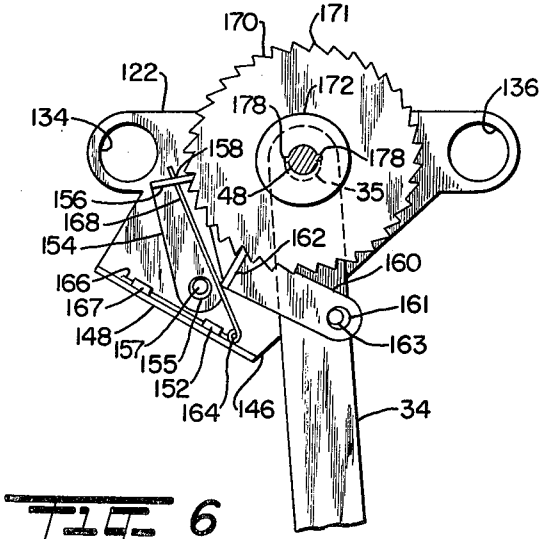
FIG. 6 is a side elevation view of the escapement mechanism taken along lines 6—6 of FIG. 2.

A second or motion imparting pawl 160 is pivotally connected to the hanger 34 and extending forwardly tangential to the ratchet wheel 170 and terminating at its distal end in a pallet 162 contacting and partially resting on the second leg 168 of spring 164 such that the leg 168 of spring 164 also biases pallet 162 of pawl 160 into engagement with the teeth 171 on ratchet wheel 170, as best seen in FIG. 6. The motion imparting pawl 160 is pivotally attached to hanger 34 by pin 163 extending through hole 161 in the lower end of motion imparting pawl 160.

As described above, the weighted body 180 acting on the reel 52 tends to rotate the shaft 48 and the ratchet wheel 170 in a forward direction which is counterclockwise as viewed in FIG. 6. The first or holding pawl 154 with its pallet 156 engaged with the teeth 171 of ratchet wheel 170 inhibits the forward rotation of the ratchet wheel 170. However, as the swing 32 moves forwardly in retrograde momentum in the swinging cycle, it also swings hanger 34 forwardly causing the second or motion imparting pawl 160 with its pallet 162 engaged with the teeth 171 of ratchet wheel 170 to rotate the ratchet wheel 170 in a reverse direction or clockwise as viewed in FIG. 6, and at the same time the pallet 162 bears against the leg 168 of spring 164 causing the pallet 156 of holding pawl 154 to move forwardly out of engagement with the teeth 171.

Then, as the swing reverses its direction of travel in the rearward direction or phase of its cycle, the hanger 34 and pawl 160 also begin to move rearwardly allowing the force of the weighted body 180 to again rotate the ratchet wheel 170 in a forward or counterclockwise direction. In this rearward phase of the cycle the force of the weighted body acting through the ratchet wheel 170 and motion imparting pawl 160 imparts an increment of rearwardly directed forced movement on the hanger 34 to maintain the swinging motion of the swing seat 32.

At the same time, as the ratchet wheel 170 rotates forwardly forcing the motion imparting pawl 160 rearwardly, the pallet 162 of pawl 160 slides downwardly on the leg 168 of spring 174 allowing the spring 164 to again bias the pallet 156 of holding pawl 154 into engagement with the next succeeding tooth 171 on the ratchet wheel 170 to again momentarily inhibit further forward rotation of the ratchet wheel 170. With the rotation of ratchet wheel 170 thereby momentarily stopped, the momentum of the swing continues to carry hanger 34 and pawl 160 rearwardly as the pallet 162 glides over the rear inclined surface of the next forwardly adjacent tooth 171 on the ratchet wheel 170 to a position where it is biased into engagement with the next adjacent tooth 171.

Then, as the swing reaches the limits of the rearward motion phase of its cycle and again moves into the forward motion phase of the cycle, the pawl 160 again on retrograde forces a slight rearwardly directed rotation of the ratchet wheel and disengagement of the pallet 156 to continue another cycle as just described above. The gravitational force on the weighted body 180 tends to maintain this cyclic pendulum motion of the swing until the cord 182 is completely unwound from the reel 52.

The hole 35 in the hanger 34 is somewhat larger in diameter than the diameter of the main shaft 48 to allow the hanger 34 to move in a slightly eliptical pattern as it swings back and forth. The mounting holes 155, 161 of the first and second pawls 154, 160, respectively, are also slightly larger in diameter than their respective mounting pins 157, 162. It has been determined that these enlarged mounting holes 34, 155, 161 are conducive to the necessary movement of the escapement mechanism components and enhance the operating efficiency and reliability of the swing by avoiding unnecessary binding and catching of the components on one another.

As mentioned briefly above, the motor 50 is also provided with a rewind mechanism for rewinding the cord 182 onto the reel 52 as the weighted body 180 is repositioned to the top of its motion path in a position of potential energy useable for again rotating the main shaft 48 of the swing. Since the motor 50 is compact and the swing 10 is intended for use by infants and small children, it is not desirable to have a large or, tightly wound, very resilient spring rewind mechanism which might be difficult to operate or even more significantly have the potential to injure if it should break or become detached from its mounting. Also, a more powerful swing should also require an excessively heavy weighted body to operate the swing and wind the spring.

This invention includes a relatively small, light and mildly resilient coiled torsion spring 102 for imparting reverse directed rotational movement to the reel 52 for rewinding the cord 182 as the weighted body 180 is lifted to the top of its guide path. Since the torsion spring 102 does not have sufficient strength to rotate the entire shaft 48 and ratchet wheel 170 in a reverse direction, a unidirectional slip clutch is provided to engage the reel 52 with the shaft 48 when the reel 52 is rotated in the forward direction, but which disengages the reel 52 from the shaft 48 when the reel 52 is rotated in the reverse direction.

Figure 5:
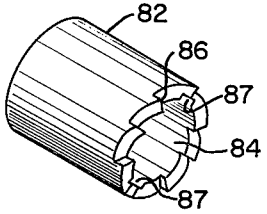
FIG. 5 is an enlarged perspective view of the clutch engagement sleeve.

This unidirectional slip clutch mechanism is best seen in FIGS. 3, 4 and 5. As described above, the reel 52 is slidably mounted on the main shaft 48 by passing the shaft 48 through the axial bore 62 in the reel 52. A cylindrical clutch sleeve 82 is positioned on the shaft 48 outside the reel 52 and is keyed to the shaft 48 by flattened keys 88 which are received into slotted keyways 87 in bore 86 of sleeve 82. Sleeve 82 is restrained against axially outward movement in relation to shaft 48 by a retainer 85 positioned in annular groove 89 provided in the right end of the shaft for that purpose.

As best seen in FIG. 5, the inward end of the cylindrical sleeve 82 is provided with an annular ring of saw-tooth shaped projections or lugs 86 around the bore 84. The reel 52 is also provided with a corresponding set of oppositely directed saw-tooth shaped projections or lugs 64 in its outside surface around the bore 62 in its hub 74. A coiled compression spring 100 is mounted between the reel 52 and the inside crossbar 122 of frame section 16 concentric with the main shaft 48 such that one end of the compression spring 100 bears against the frame crossbar 122 and the opposite end bears against the hub 74 of reel 52, thereby biasing the lugs 64 on the reel 52 into engagement with the lugs 86 on the clutch sleeve 82. Therefore, when the weighted body 180 is unwinding itself from reel 52, thereby rotating the reel 52 in a forward direction, the lugs 64 in the reel 52 are engaged with the lugs 86 on the clutch sleeve 82 causing the sleeve 82 and therefore the shaft 48 to also rotate in the forward direction. However, when the weighted body 180 is being lifted to the top of its guide path and the reel 52 is being rotated in a reverse direction by the torsion spring 102, the lugs 64 in the reel and the lugs 86 in the sleeve 82 do not engage each other. Instead, the reel 52 slides slightly axially inward against the bias of the compression spring 100 to allow the respective lugs 64, 86 to glide over one another thereby allowing the reel 52 to rotate in a reverse direction independent of the sleeve 82 and the shaft 48.

As illustrated in FIGS. 3 and 4, a spring retainer 90 is positioned around the shaft 48 against the inside crossbar 122 of the right frame section 16. The spring retainer 90 includes an annular plate 92 having anchor stubs 94, 96 extending into corresponding holes 95, 97, respectively, in the inside crossbar 122 to prevent rotation of the annular plate 92. The spring retainer 90 also includes a cylindrical portion 98 with an inside bore 99 extending axially outwardly from the annular plate 92 in radially outwardly spaced concentric relation to the shaft 48. The inward end of the compression spring 100 is positioned within the bore 99 of the cylindrical portion 98, and the inward end of the torsion spring 102 is positioned around the outside peripheral surface of the cylindrical portion 98, all in concentric relation to the shaft 48.

The hub 74 of the reel 52 has an outside peripheral surface of the same diameter as the outside peripheral surface of the cylindrical portion 98 around which the outer end of the torsion spring 102 is positioned. A bore 78 extends axially inwardly from the inward end of the hub 74 forming a cylindrical housing 80 in radially outwardly spaced concentric relation to the shaft 48. The outer end of the compression spring 100 is positioned and retained within the bore 78 in the cylindrical housing 80.

The outward end 104 of the torsion spring 102 is bent to extend axially outward into engagement with a corresponding anchor hole 105 in the flange 68 of reel 52. Similarly, the inward end 106 of torsion spring 102 is bent to extend axially inwardly into engagement with a corresponding anchor hole 107 in the annular plate 92 of spring retainer 90. Therefore, as the reel 52 rotates forwardly at the urging of the unwinding cord 182 and weighted body 180, the torsion spring 102 is wound against its bias thereby storing potential energy. When the weight 180 is lifted to the top of its guide path, its force is removed from the reel 52 and the bias of the torsion spring 102 acting through its end 104 is able to rotate the reel 52 in a reverse direction to rewind the cord 182 onto the reel 52.

As described above, the end 106 of torsion spring 102 is anchored into the annular plate 92 of spring retainer 90. Spring retainer 90 is prevented from rotating by the stubs 94, 96 positioned in holes 95, 97, respectively in the inner crossbar 122 of right frame section 16. It can be appreciated therefore, that if the stubs 94, 96 were to become dislodged from the corresponding holes 95, 97, respectively, the spring retainer 90 would rotate causing the torsion spring to unwind and lose its effectiveness as a rewind mechanism. Therefore, a limit stop means is provided to limit axially outward sliding of the spring retainer 90 to an amount less than the length of the stubs 94, 96 to prevent disengagement of the spring retainer 90 from the crossbar 122. The limit stop is comprised of an annular shoulder 76 around the hub 74 of reel 52. As best seen in FIG. 3, the cylindrical portion 98 of spring retainer 90 slides over the cylindrical housing 80 of the reel hub 74, thereby providing stability of the respective components while allowing the reel 52 to slide axially inward against the bias of the compression spring 100 as required to allow slippage between the reel 52 and the clutch sleeve 82 while rotating in the reverse direction as described above. However, the extent of axial sliding of the reel 52 in relation to the spring retainer 90 is limited by the distal end 101 of cylindrical portion 98 abutting against the annular shoulder 76 in reel hub 74. Therefore, when the axial distance between the distal end 101 and the shoulder 76 provided is less than the length of the stubs 94, 96, as described in this invention, the spring retainer 90 cannot become disengaged from the inner crossbar 122 of the frame, yet, sufficient axial sliding of the reel 52 is allowed to glide over the lugs 62, 86 in the clutch mechanism when the reel 52 is rotating in the reverse direction.

Figure 8:
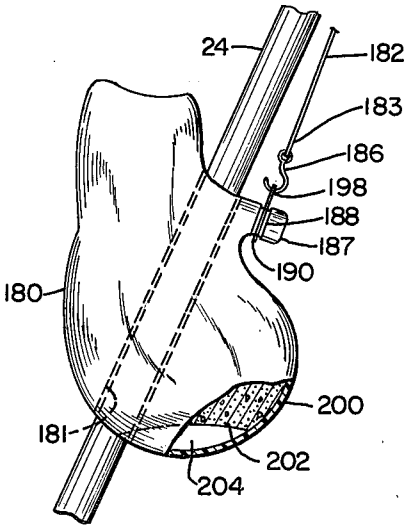
FIG. 8 is an enlarged, partially fragmented elevation view of the weighted body mounted on the leg and attached to the flexible cord.

As shown in FIGS. 1 and 8, the weighted body 180 has a bore 181 through its midsection and is mounted on the right forward leg 24 with the leg 24 extending through the bore 181 to provide a guide path for the weight as it moves downwardly during operation of the swing. Therefore, the weighted body 180 is prohibited from swinging dangerously, again to prevent injury to children, and the leg provides a convenient location for the weighted body both for easy repositioning to the upper position to restart the swing operation and for a sight indicator to show approximately how much time is left in the swing operation before the weighted body 180 has to be repositioned.

For example, the position of the weighted body 180′ as shown in FIG. 1 is near its maximum height where the cord is fully wound around the reel 52. During the operation of the swing, the weighted body glides slowly downwardly on the leg 24 until it reaches its completely unwound position indicated at 180″ near the bottom of the leg 24. When the weighted body is approximately half way down the leg 24 as indicated at 180, the parent will know that approximately half of the swinging time has elapsed and approximately half of the time remains to be used.

The cord 182 is provided of a length so that it is fully unwound when the weighted body is still several inches above the floor, again to prevent any injury to a child's foot if for some reason a component of the motor should break or malfunction allowing the weighted body to fall to the bottom of its path. In the alternative, a safety sleeve 206, as shown in FIG. 1, can be provided at the bottom of leg 24 to limit the extent of downward travel of the weighted body 180.

Figure 9:
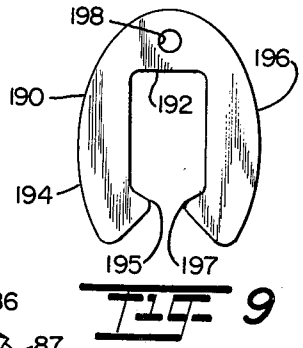
FIG. 9 is an enlarged elevation view of the releasable attachment clip for attaching the flexible cord to the weighted body.

As shown in FIGS. 8 and 9, the flexible cord 182 is attached to weighted body 180 by spring clip 190 removably positioned in a groove 188 in an appendage 187 of the weighted body 180 provided for that purpose. The clip 190 is generally shaped like a horseshoe having two spaced-apart legs 194, 196 extending from a common cross piece 192. The distal ends 195, 197 of legs 194, 196, respectively, are returned inward toward each other to form a restricted clearance therebetween. The clip is strong enough to hold the weight of the body 180 suspended by the cord 182; however, the legs 194, 196 will yield and allow the clip 190 to be detached from the appendage 187 upon application of an abnormal load. The cross piece 192 has a hole 198 therethrough for receiving and retaining hook 186 at the lower end 183 of cord 182. Therefore, in the event some abnormal load is placed on the weighted body 180, such as from a child pulling on or hanging from the body 180, the clip 190 will release the attachment of the cord 182 to the body 180 before a sufficient abnormal force is applied to damage any components of the motor mechanism.

The weighted body 180, as shown in FIG. 8, is preferably constructed of a blow-molded, resilient plastic shell 200, which is mostly filled with a heavy material such as cement 202 that cures into a hardened mass. It is also preferable to leave an unfilled space or air pocket 204 at the bottom of the weighted body 180 between the resilient plastic shell 200 and the cement 202 as an additional safety feature. The air pocket 204 and resilient plastic shell 200 will cushion an impact in the event the weighted body should fall on a child's foot or hand.

Although the present invention has been described with a certain degree of particularity, it is understood that the present disclosure has been made by way of example and that changes in details of structure may be made without departing from the spirit thereof.

What is claimed is:

1. In a swing apparatus wherein a portable frame has first and second structural sections fastened together in rigid, spaced-apart relation and a plurality of downwardly extending support means for supporting said first and second sections a spaced distance above a surface on which the swing apparatus is set, two of said support means extending substantially downwardly from said first section with an acute angle therebetween and the remaining two of said support means extending downwardly from said second section with an acute angle therebetween, the improvement comprising:

a shaft extending between and journaled in said first and second sections, a seat hanger mounted between said first and second sections, and a seat suspended from said hanger; and actuator means on said shaft connected to said hanger for imparting swinging motion to said seat, said actuator means including weight-biased drive means adapted to impart rotating motion to said shaft in a first direction, escapement means including a ratchet wheel concentrically mounted on said shaft for governing the rotational movement of said shaft, rewind means for returning said weight-biased drive means in the reverse direction as it is returned to a position of potential energy usable for driving said actuator means, said drive means including a weighted body constrained for movement along one of said support means and a reel rotatably journaled on said shaft, and unidirectional clutch means concentrically mounted on said shaft for selectively engaging said weight-biased drive means with said shaft.

2. The swing apparatus of claim 1 wherein said weight-biased drive means also includes a flexible cord, one end of which is attached to said weighted body and the opposite end of which is attached to and windable around said reel, said weighted body having a bore extending therethrough and slidably mounted on one of said support means with said one support means extending through said bore, and said rewind means connected to said weight-biased drive means for resetting said reel and said cord when said weighted body is returned to a state of potential energy usable for driving said actuator means.

3. The swing apparatus of claim 2, including a soft resilient bottom portion on said weighted body.

4. The swing apparatus of claim 3, wherein said weighted body is a blow-molded resilient plastic shell filled with a dense, hardened substance with an unfilled space between said resilient plastic shell and said hardened material at the bottom portion of said weighted body.

5. The swing apparatus of claim 1, wherein said clutch means is an axial biased unidirectional slip clutch including a cylindrical sleeve mounted on and immovably attached to said shaft on one side of said reel, said sleeve having an annular ring of a plurality of saw-toothed shaped extensions on one end, said reel having a corresponding annular ring of a plurality of saw-toothed shaped extensions oppositely directed and interfacingly engaged with said extensions on said sleeve, and a coiled compression spring on the opposite side of said reel from said sleeve, one end of which bears against said first frame sections and the opposite end of which bears against said reel to yieldingly maintain said reel in engagement with said sleeve.

6. The swing apparatus of claim 5, wherein said rewind means includes a coiled torsion spring, one end of which is fastened to said first frame section and the opposite end of which is fastened to said reel.

7. The swing apparatus of claim 6, including limit stop means between said reel and said first frame section for limiting the axial sliding movement of said reel on said shaft to an amount sufficient to allow said respective projections on said sleeve and said reel to slide over one another.

8. The swing apparatus of claim 7, wherein said escapement means includes a ratchet wheel immovably mounted on said shaft between said first and second frame sections adjacent said first frame section with one of said seat hangers positioned between said ratchet wheel and said first frame member, a first pawl pivotally connected to said first frame section, a pin spring, one leg of which is affixed to said first frame section and the other leg of which extends into engagement with said first pawl, the bias of said pin spring acting on said first pawl tending to urge said first pawl into engagement with said ratchet wheel, and a second pawl pivotally connected to said one hanger and in sliding contact with said other leg of said pin spring such that the bias of said pin spring also tends to urge said second pawl into engagement with said ratchet wheel and forced movement of said second pawl by said other hanger against the bias of said pin spring moves said other leg of said pin spring away from said ratchet wheel to cause said first pawl to move out of engagement with said ratchet wheel.

9. The swing apparatus of claim 8, wherein the other support means attached to said first frame section and the corresponding support means attached to said second frame section are pivotally attached to the respective first and second frame sections such that they are foldable to a position substantially parallel to said one support means of said first frame section and to the support means in said second frame section correspondingly adjacent said one support means in said first frame section.

10. The swing apparatus of claim 7, wherein said shaft extends through a hole in said one hanger which is larger in diameter than said shaft to accommodate slightly elliptical movement of said one hanger.

11. The swing apparatus of claim 5, including releasable attachment means for releasably attaching said flexible cord to said weighted body, said releasable attachment means having sufficient strength to normally support the weighted body while being yieldable to a force on said weighted body in addition to its weight to release said weighted body from said flexible cord in response to additional force.

12. The swing apparatus of claim 1, wherein each of said support means is defined by a downwardly extending leg member, said weighted body constrained for movement along one of said legs, and limit stop means on said one leg for limiting the downward travel of said weighted body on said one leg to a spaced distance above the bottom of said one leg.

13. The swing apparatus of claim 12, wherein said limit stop means includes a cylindrical stop sleeve positioned around the bottom extremity of said one support means, said stop sleeve being larger in diameter than said bore through said weighted body and being positioned with its upper end a spaced distance above the bottom of said one support means.

14. Swing apparatus, comprising:

a structural frame and support means for supporting said frame;

a main shaft extending transversely from the right to the left ends of said frame and journaled therein for rotation;

a right swing hanger and a left swing hanger, both of which are mounted between said ends of said frame, and a swing seat suspended from said right and left hangers;

actuator means for moving said swing in a pendulum motion, including weight-biased drive means having a drive weight for urging said shaft to rotate, escapement means for governing the rotation of said shaft, unidirectional clutch means for engaging said drive means with said shaft, and automatic rewind means for urging said drive means in a reverse rotational direction automatically in response to repositioning of said drive means to a position of potential energy usable for driving said swing; and said drive means, escapement means, clutch means, and rewind means all being mounted concentric to a common longitudinal axis which is also common with the longitudinal axis of said main shaft.

15. The swing apparatus of claim 14, wherein said drive means includes a reel slidably mounted on said main shaft, and a flexible cord, one end of which is attached to said weighted body, and the other end of which is windable around and attached to said reel, said escape means includes a ratchet wheel mounted on and in immovable relation to said main shaft and first and second pawls, said first pawl being pivotally attached to said frame and said second pawl being pivotally attached to said right hanger, said clutch means including a cylindrical sleeve with an annular ring of a plurality of saw-tooth shaped projections on one end thereof mounted on and in immovable relation to said main shaft, an annular ring of corresponding oppositely directed saw-tooth shaped projections on one side of said reel concentric with said main shaft, and a compression spring positioned concentrically around said main shaft on the side of said reel opposite said annular ring of saw-tooth shaped projections, one end of said compression spring bearing against said frame and the opposite end of said compression spring bearing against said opposite side of said reel to urge said saw-toothed projections on said reel into interfacing, unidirectional engagement with said saw-toothed projections on said sleeve, said escapement means including a ratchet wheel mounted on and in immovable relation to said main shaft and first and second pawls, said first pawl pivotally attached to said frame and said second pawl pivotally attached to said right hanger, and said rewind means including a coiled torsion spring positioned concentrically over said compression spring, one end of said torsion spring being anchored to said frame and the other end of said torsion spring being connected to said reel to bias said reel and urge rotation thereof in a direction opposite that imparted on said reel by said weighted body.

16. The swing apparatus of claim 15, wherein said reel has a cylindrical hub extending axially from its opposite end, an enlarged axial bore extending axially into said hub from said opposite side of said reel, said opposite end of said compression spring being positioned within said enlarged bore in said hub and said opposite end of said torsion spring being positioned around the outside peripheral surface of said hub, and including a spring retainer adjacent and anchored to said frame between said frame and said reel having a cylindrical projection extending axially toward said reel in radially outward concentric relation to said main shaft, said one end of said compression spring being positioned within said cylindrical projection and said one end of said torsion spring being positioned around the outside peripheral surface of said cylindrical projection.

17. The swing apparatus of claim 16, wherein said spring retainer is anchored to said frame by a stub extending into a corresponding hole in said frame a radially outward spaced distance from said main shaft, said hub on said reel includes an annular shoulder around its peripheral surface inside said torsion spring in axial alignment with the distal end of said cylindrical projection on said spring retainer, the axial distance between said annular shoulder and said distal end of said cylindrical projection being less than the length of said stub extending into said hole in said frame such that said stub is precluded from becoming completely retracted out of said hole in said frame, and said one end of said torsion spring is anchored to said spring retainer.

18. The swing apparatus of claim 17, wherein said reel includes a pair of annular flanges extending radially outward in axially spaced-apart relation to each other, each of which flanges includes an annular collar extending toward the other flange to form a restricted opening to an enlarged cord winding and storage area between said flanges, and each of said flanges having a portion sloping outwardly away from the other flange radially outward from said collar to form an inclined guide for said cord leading toward said restricted opening.

* * * * *